United States Patent [19]

Munker

[11] 4,127,983

[45] Dec. 5, 1978

[54] YARN GUIDING AND THREADING MECHANISMS FOR USE WITH TEXTILE YARN PROCESSING MACHINES

[75] Inventor: Gert Munker, Krefeld, Germany

[73] Assignee: Palitex Project Company GmbH, Krefeld, Germany

[21] Appl. No.: 845,719

[22] Filed: Oct. 26, 1977

[30] Foreign Application Priority Data

Oct. 27, 1976 [DE] Fed. Rep. of Germany ..... 2648621

[51] Int. Cl.[2] ..... D01H 15/00; D01H 1/10

[52] U.S. Cl. ..... 57/279; 57/58.7; 226/97; 242/35.6 R; 57/305

[58] Field of Search ..... 57/34 R, 34.5, 58.49, 57/58.7, 106; 242/35.5 R, 35.5 A, 35.6 R, 35.6 E; 226/97, 7

[56] References Cited

U.S. PATENT DOCUMENTS

| | | | |
|---|---|---|---|
| 3,131,879 | 5/1964 | Glastra et al. | 242/35.6 E |
| 3,144,187 | 8/1964 | Naumann | 226/97 X |
| 3,595,493 | 7/1971 | Tsukuma et al. | 242/35.6 R |
| 3,599,886 | 8/1971 | Koller | 242/35.6 R X |
| 3,605,396 | 9/1971 | Guignard et al. | 57/34.5 X |
| 3,731,478 | 5/1973 | Franzen | 57/58.7 |
| 3,810,352 | 5/1974 | Miyazaki et al. | 57/34 R |
| 3,975,893 | 8/1976 | Franzen | 57/34 R |
| 3,981,128 | 9/1976 | Munker | 226/97 X |
| 4,026,095 | 5/1977 | Kobatake et al. | 57/34.5 |

*Primary Examiner*—John Petrakes

*Attorney, Agent, or Firm*—Bell, Seltzer, Park & Gibson

[57] ABSTRACT

Yarn guiding and threading mechanisms for use with textile machines processing yarn, such as during a threading-up operation of the textile machine, are characterized by a construction adapted for receiving a free end of yarn from a first location in the machine, for guiding the yarn from such first location and for conveying the yarn to a desired second location in the machine, as follows. An elongate tube has an air passageway therethrough, a source of suction connected to one end thereof for creating a suction therethrough for receiving at the other end of the yarn from the first location in the textile machine and for guiding the yarn through the tube, and a slot extending from the outside to the passageway along the length thereof and positioned on the side adapted to face the textile machine for subsequent removal of the yarn from the tube. A yarn carrier is movably mounted for movement between a first position for engaging the yarn passing through the tube to a second position at the second location in the textile machine for conveying the yarn from the tube through the slot therein and positioning the yarn at the second location in the textile machine. Preferably, a movable trolley mechanism carries the yarn guiding and threading mechanisms for convenient positioning thereof at a desired location along the textile machine. Preferably, driven delivery rolls are positioned for receipt of the yarn after the free end has passed through the tube for further feeding of the yarn from the first location in the textile machine and into the suction source during movement of the yarn carrier to its second position at a desired speed of travel for acceptance of the yarn by the textile machine at the second location.

29 Claims, 9 Drawing Figures

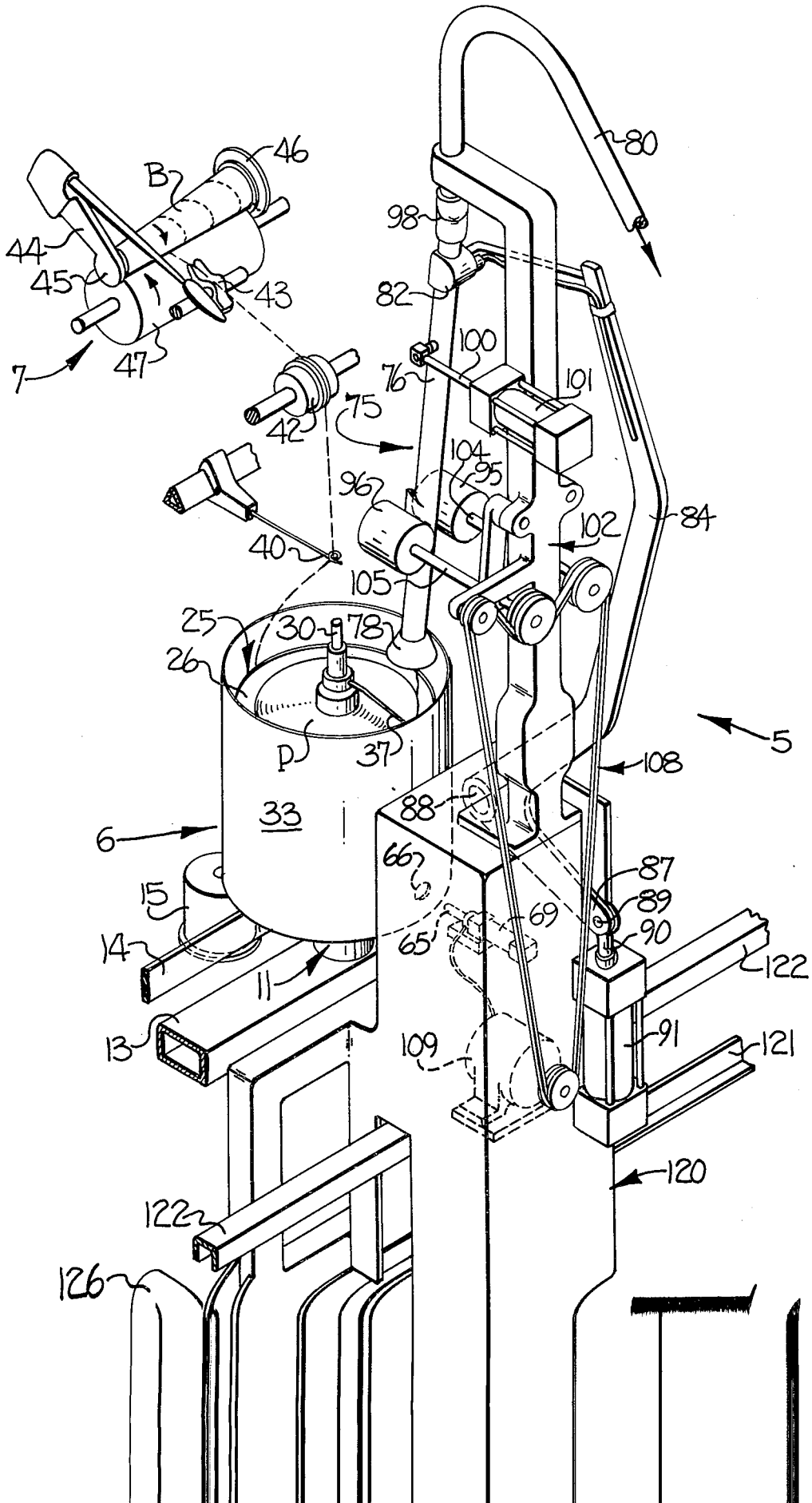
80
46
B
44
45
43
7
47
98
82
100
76
101
75
42
104
95
96
84
102
40
105
25
30
78
26
p
37
5
108
33
88
6
66
87
89
15
69
90
14
65
122
11
13
109
91
121
120
122
126

YARN GUIDING AND THREADING MECHANISMS FOR USE WITH TEXTILE YARN PROCESSING MACHINES

This invention relates to a yarn guiding and threading means for use with textile machines processing yarn, preferably yarn processing machines such as two-for-one twisters having a plurality of spindle assemblies mounted in generally side-by-side relationship along the outside of the machine and carrying a supply package of yarn for processing of the yarn during passage through the spindle assembly and a processed yarn take-up assembly positioned above each of the spindle assemblies for forming a take-up package of processed yarn and selectively-operable threading mechanisms for automatically threading yarn from the supply package through the spindle assembly, characterized by a construction adapted for receiving a free end of yarn from a first location in the machine or from the spindle assembly, for guiding the yarn from such location and for conveying the yarn to a desired second location or to the take-up assembly in the textile machine.

BACKGROUND OF THE INVENTION

In textile machines which process yarn, it is often necessary to grasp a free end of the yarn at a first location and to convey this free end of yarn to another desired second location in the textile machine. This is particularly true in the case of a two-for-one twister textile yarn processing machine and other yarn processing machines having yarn processing stations mounted in generally side-by-side relationship along the outside of the machine and each having a spindle assembly carrying a supply package of yarn for processing of the yarn during passage through the spindle assembly and a processed yarn take-up assembly positioned generally axially above each of the spindle assemblies for receiving the processed yarn therefrom and for forming a take-up package of processed yarn, wherein the yarn must be grasped from the spindle assembly and conveyed to the take-up assembly during threading-up of each yarn processing station following doffing of a full package of processed yarn or the breakage of yarn during yarn processing.

In the case of such two-for-one twister textile yarn processing machines, the spindle assemblies each include a driven rotating rotor mechanism, a stationary carrier mechanism for carrying a hollow supply package of yarn and having a basket device surrounding the supply package, a balloon limitor device surrounding the basket device and providing a space therebetween, and an elongate yarn passageway extending downwardly through the top of the carrier mechanism along the axis of the spindle assembly and radially outwardly through the rotor mechanism into the space between the basket device and the balloon limitor for the passage of yarn from the supply package downwardly and outwardly through the passageway and upwardly through the space between the balloon limitor and basket device during yarn processing. From the spindle assembly, the yarn passes through the take-up assembly which conventionally includes a yarn guide eyelet, a pre-take-up roll, a yarn traversing mechanism and a yarn take-up or package roll device including a cradle mechanism having centering discs for carrying a surface-driven take-up yarn bobbin therebetween for the winding of processed yarn thereon through surface engagement with a driven friction drive roll.

Some of these two-for-one twister textile yarn processing machines are provided with automatic threading mechanisms particularly for the spindle assembly portions of the yarn processing stations, such as the pneumatic threading mechanisms disclosed in U.S. Pat. No. 3,731,478 issued May 8, 1973 and U.S. Pat. No. 3,975,873, issued Aug. 24, 1976, both of which are assigned to the assignee of the present invention.

As may be seen in these U.S. patents, pneumatic threading mechanisms are provided for automatically threading yarn withdrawn from the supply package through the yarn passageway of the spindle assembly and through the space provided between the balloon limitor and the basket device by creating a suction through the yarn entry portion of the spindle assembly passageway and a positive air stream through the yarn exit portion of the passageway and through the space between the balloon limitor and basket device. However, the yarn must then be grasped as it emerges upwardly from the space between the balloon limitor and the basket device of the spindle assembly and conveyed to the take-up bobbin in the take-up assembly. This may be accomplished either manually or automatically.

In this regard, assignee's U.S. Pat. No. 3,731,478 discloses further threading devices in the form of an air injector nozzle disposed over the gap between the balloon limitor and basket device of the spindle assembly for capturing the yarn propelled upwardly through this space so that the yarn may be passed through the thread guide eyelet associated with the take-up assembly. After the yarn has passed through this thread guide eyelet, the yarn must be manually conveyed over the remaining elements of the take-up assembly and applied to the take-up bobbin. In an additional embodiment of these further threading devices of assignee's U.S. Pat. No. 3,731,478 there is disclosed the use of deflection members in connection with the injector nozzle for deflecting the yarn upwardly toward the take-up bobbin so that operator need only grasp the yarn at the location of the take-up bobbin and apply the yarn to the take-up bobbin during threading-up of the yarn processing station.

However, with all the above-described mechanisms and with all of the automatic threading mechanisms for yarn processing stations of textile machines presently known, some manual labor by an operator is required in the threading-up of the yarn from the spindle assembly to the take-up assembly or from a first location in the textile machine to a desired second location in the textile machine.

OBJECTS AND SUMMARY OF THE INVENTION

Accordingly, it is the object of this invention to provide an improved yarn guiding and threading means for use with textile yarn processing machines, such as during a threading-up operation of the textile machine, characterized by a construction adapted for receiving a free end of yarn from a first location in the machine, for guiding the yarn from such first location and for conveying the yarn to a desired second location in the machine for receipt at the second location in the machine to eliminate manual handling of the yarn.

It is a further more specific operation of this invention to provide such improved yarn guiding and threading means in a textile yarn processing machine having spindle assemblies each carrying a supply package of yarn for processing of the yarn during passage through the spindle assembly and a processed yarn take-up assembly positioned generally axially above each of the spindle assemblies for receiving the processed yarn and for forming a take-up package of yarn, and preferably having selectively operable threading mechanisms in each spindle assembly for automatically threading yarn from the supply package through the spindle assembly for emerging from the spindle assembly generally at the top thereof, wherein the yarn guiding and threading means of this invention will receive and guide the yarn emerging from the spindle assembly during threading-up thereof and convey the yarn to the take-up assembly for automatic threading-up thereof eliminating manual handling of the yarn.

It has been found by this invention that the above objects may be accomplished by providing such yarn guiding and threading means comprising the following. An elongate, preferably vertically-extending, tube includes an air passageway therethrough and a source of suction connected to one end, preferably the upper end, of the tube for creating a suction through the tube for receiving at the other or lower end of the tube the yarn from a first location in the textile machine, preferably as the free end passes upwardly from between the basket device and the balloon limitor of the spindle assembly, and for guiding the yarn through the tube. The tube further includes a slot extending from the outside thereof to the passageway therein along the length thereof and positioned on the side thereof adapted to face the textile machine for subsequent removal of the yarn from the tube. A yarn carrier is provided which includes means movably mounting the carrier for movement between a first position for engaging the yarn passing through the tube to a second position at the second location in the textile machine, preferably closely adjacent the take-up bobbin in the cradle device of the take-up assembly for conveying the yarn from the tube through the slot therein and positioning the yarn at the second location in the textile machine, preferably on the take-up bobbin to complete threading-up of the spindle assembly and take-up assembly to eliminate manual handling of the yarn during threading-up operations.

The cradle mechanism of the take-up assembly of the textile machine preferably includes centering discs between which the take-up bobbin is held and one of which centering discs has an oblique surface for forming a gap between the surface and the bobbin; so that, when the yarn is conveyed and applied to the take-up bobbin by the yarn carrier, the yarn will be positioned within the gap between the bobbin and the oblique surface of the one centering disc to be held within this gap during start-up of the yarn processing station.

The yarn guiding and threading means preferably includes a movable trolley mechanism adapted to be positioned along the outside of the textile machine and carrying the yarn guiding and threading means for conveniently positioning the yarn guiding and threading means at desired locations along the textile machine, preferably at a desired spindle and take-up assembly of a yarn processing station.

In the preferred form of a yarn guiding and threading means according to this invention, the yarn receiving end of the tube is funnel-shaped for aiding in receiving the yarn. Also, a suction conduit is connected to the other end of the tube and leads therefrom to the source of suction for creating a suction through the tube and for receiving and holding the free end of yarn in the conduit. There may also be provided an enlarged pocket portion in the upper end of the tube having an opened front adapted to face the textile machine for forming a part of the yarn passageway through the tube. The yarn carrier preferably has a hook portion on one end thereof open toward the textile machine for being positioned within the pocket portion of the tube and forming a part of the passageway therethrough in the first position of the yarn carrier for movement out of the pocket position for conveying the yarn from the tube to the slot therein when moved to the second position of the yarn carrier.

The preferred form of yarn guiding and threading means also includes driven delivery roll means operatively positioned with respect to the tube for receipt of the yarn after the free end has passed into the suction conduit for further feeding of the yarn from the first location or spindle assembly in the textile machine into the suction conduit during movement of the yarn carrier to its second position. With this arrangement, means pivotally mount the upper end of the tube for movement from a first position for receipt of the free end of the yarn from the first location or from the spindle assembly to a position out of the path of travel of the yarn from such first position into the suction conduit so that the yarn will be removed from the slot in the tube. Means also mount the delivery roll means for pivotal movement from a first position out of yarn feeding engagement with each other when the tube is in its first position to a second position in engagement with each other for receiving the yarn and for feeding the yarn at a desired speed when the tube is moved to its second position. This is particularly preferable for applying the yarn to the take-up bobbin while the yarn is traveling at a speed closely approximating the speed of rotation of the take-up bobbin.

The preferred form of yarn guiding and threading means according to this invention also includes a cutter means carried by the yarn carrier for being selectively actuated when the yarn carrier moves to its second position or adjacent the take-up bobbin for cutting the yarn so that the free end thereof may be conveyed through the suction conduit for removal and the cut end is free for receipt at the second location in the textile machine or onto the take-up bobbin for completing threading-up operations of the yarn processing station.

Accordingly, this invention has provided a yarn guiding and threading means which may be used with textile machines, particularly yarn processing textile machines such as a two-for-one twister, which will receive a free end of yarn from a first location in the textile machine, preferably emerging from a spindle assembly during automatic threading-up thereof, guide the yarn from such first location and convey the yarn to a desired second location in the textile machine, preferably to the take-up assembly for automatic threading-up of the yarn between the spindle assembly and the take-up assembly to eliminate manual handling of the yarn during threading-up operations.

BRIEF DESCRIPTION OF THE DRAWINGS

Some of the objects and advantages along with a broad description of this invention have been set forth above; however, other objects, advantages and a more detailed description of the invention will appear as the description proceeds, when taken in conjunction with the following drawings, in which:

FIG. 1 is a somewhat schematic, perspective view, of one yarn processing station including a spindle assembly, a take-up assembly and yarn guiding and threading mechanisms in accordance with this invention of a two-for-one twister textile yarn processing machine;

DESCRIPTION OF PREFERRED EMBODIMENT

While the drawings and specific description to follow will be related to a two-for-one twister textile yarn processing machine, having pneumatic spindle assembly threading mechanisms in accordance with assignee's above-mentioned U.S. Pat. No. 3,975,893, which is the preferred textile machine and the preferred spindle assembly pneumatic threading mechanisms for use with the yarn guiding and threading mechanisms of this invention, it is to be understood that the yarn guiding and threading mechanisms of this invention could be utilized with other textile machines and with two-for-one twister yarn processing machines having other types of automatic threading mechanisms.

Figure 2:
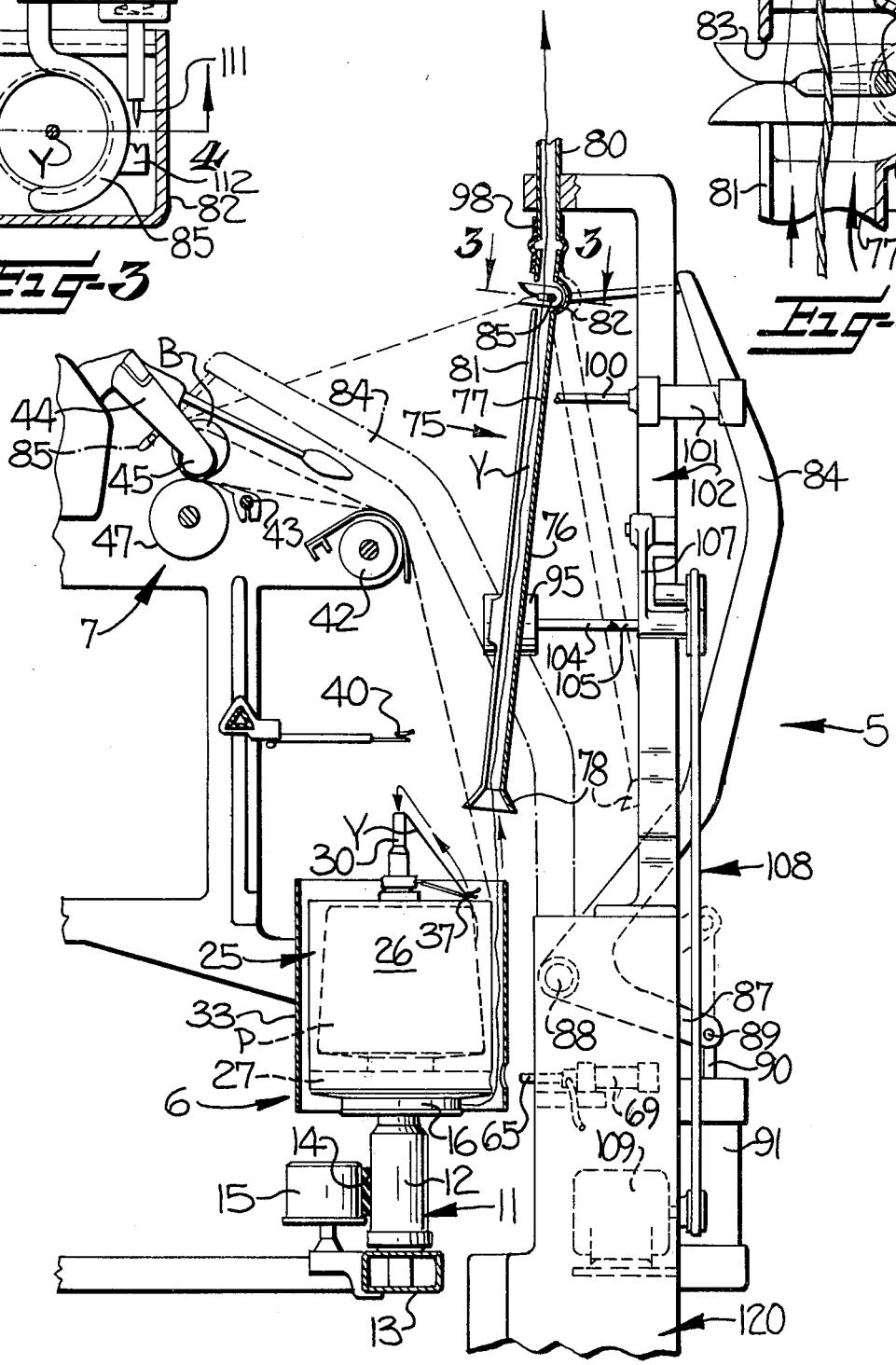
FIG. 2 is a side elevational view, partly in section, of the mechanisms illustrated in FIG. 1.
Figure 8:
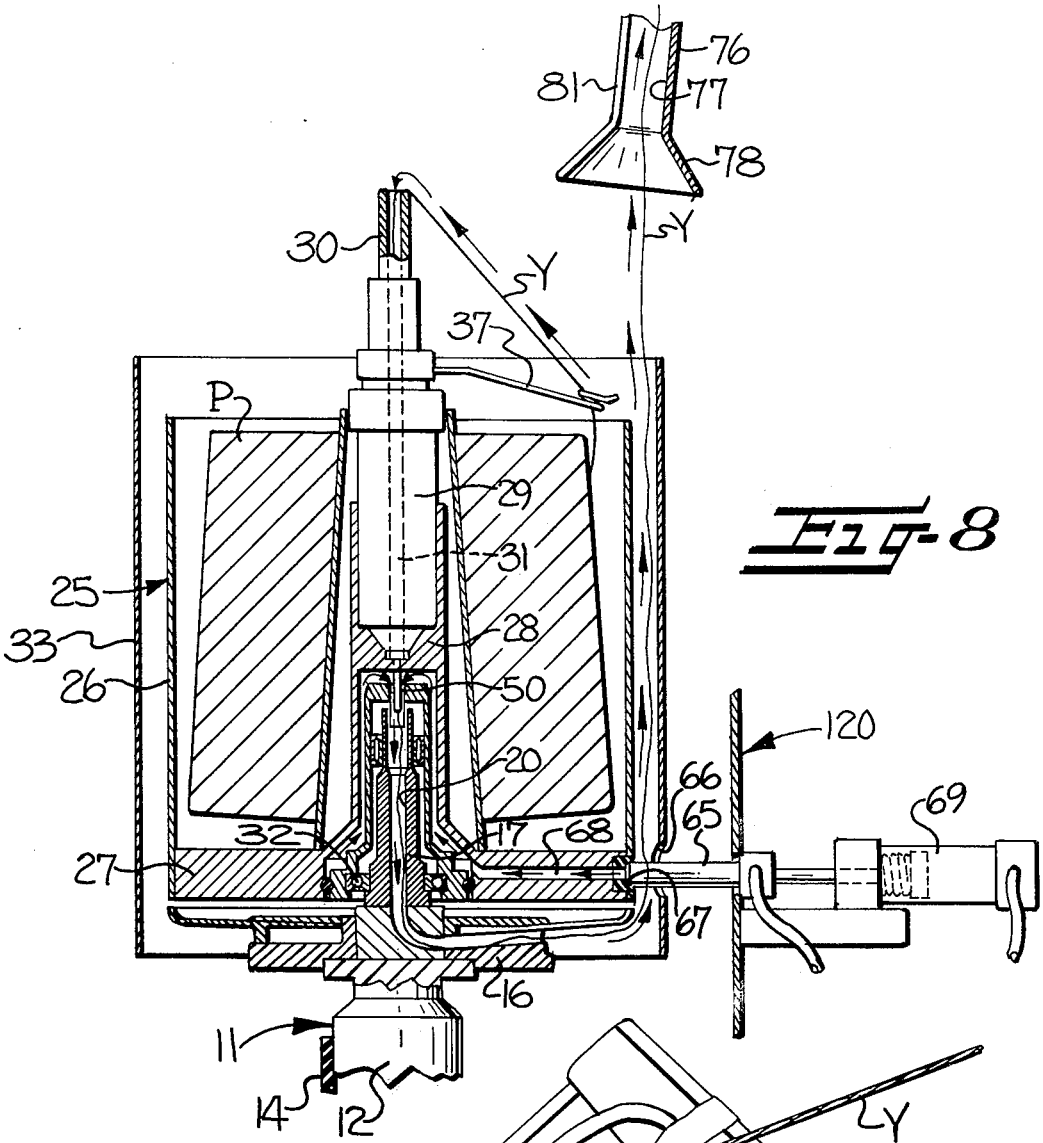
FIG. 8 is an elevational, cross-sectional view through the spindle assembly shown in FIG. 1 and illustrating pneumatic spindle assembly threading mechanisms.

Referring now to the drawings, there is illustrated in FIG. 1, along with FIGS. 2 and 8, a schematic perspective view of a single yarn processing station, generally indicated at 5, of a two-for-one twister textile yarn processing machine each of which includes a spindle assembly 6 and a take-up assembly 7 positioned axially above the spindle assembly 6. It is to be understood that a plurality of these yarn processing stations 5 including the spindle assembly 6 and the take-up assembly 7 are provided in a two-for-one twister in side-by-side relationship in two rows along the outside of the machine. A full illustration and description of the entire two-for-one twister is not given herein and is not believed to be necessary for an understanding of the present invention, the operation and complete structure of such two-for-one twisters are well understood to those with ordinary skill in the art.

Each of the spindle assemblies 6 (see FIGS. 1, 2 and 8 particularly) comprise a rotatably driven rotor mechanism, generally indicated at 11, which includes a whorl portion 12 suitably rotatably mounted on a portion of the twister frame 13 and rotated by a continuous tangential drive belt 14 in a manner well understood by those with ordinary skill in the art. Tension rolls 15 are associated with each spindle assembly 6 and are pivotally mounted for engaging and holding the drive belt 14 in tight driving engagement with the whorl portion 12 for normal rotation of the rotor mechanism 11 of the spindle assembly 6. The rotor mechanism 11 further includes a horizontally-extending yarn reserve disc device 16 secured to the whorl 12 for rotation therewith and a generally vertically-extending hollow axle device 17 which also rotates with reserve disc 16. The reserve disc 16 and hollow axle device 17 define therewithin a generally L-shaped passageway 20 extending generally vertically through the hollow axle device 17 and a portion of the reserve disc 16 and generally horizontally and radially out of the yarn reserve disc 16.

The spindle assembly 6 further includes a stationary carrier mechanism, generally indicated at 25, for supporting and carrying a hollow package P of yarn Y and which is rotatably mounted on rotor mechanism 11, so that rotor mechanism 11 may rotate relative thereto. The carrier mechanism 25 comprises a basket device 26 which surrounds the package P of yarn Y, a circular bottom portion 27 for supporting the hollow yarn package P and a hollow hub portion 28 extending into the hollow yarn supply package P for stabilizing the yarn supply package. The hollow hub portion 28 may include a hollow yarn package carrier member 29 in partial telescoping relationship therein which carries a hollow yarn entry tube 30 at the upper end thereof. As may be seen particularly in FIG. 8, the hollow axle device 17 of the rotor mechanism 11 extends into the hollow hub portion 28 of the carrier mechanism 25 and the carrier mechanism 25 is rotatably mounted on the rotor mechanism 11 by means of bearings 32, so that the rotor mechanism 11 may rotate relative to the stationary carrier mechanism 25 which is held stationary by any suitable means, such as magnetic means (not shown).

The carrier mechanism 25 including the carrier member 29, the yarn entry tube 30 and the hollow interior of the hub portion 28 define a generally vertically-extending yarn passageway 31 which is disposed in axial alignment with the yarn passageway 20 through the rotor mechanism 11 and joins with the yarn passageway 20 for providing a continuous elongate passageway 31, 20 passing downwardly through the top of the carrier mechanism 25, along the axis of the spindle assembly 6 and radially outwardly through the yarn reserve disc 16 of the rotor mechanism 11.

The spindle assembly 6 further includes a stationary balloon limitor device 33 surrounding the basket device 26 of the carrier mechanism 25 and providing a space therebetween for the passage of yarn. There is further provided a pigtail flyer mechanism 37 rotatably mounted on the carrier member 29.

The take-up assembly 7 of the yarn processing station 5 includes a yarn guide eyelet 40, preferably of a conventional pigtail shape, positioned above and in axial alignment with the yarn entry tube 30 and the yarn passageway 31 therethrough of the spindle assembly 6. The take-up assembly 7 also includes a pre-take-up roll 42 and a yarn traversing mechanism 43. There is further provided a yarn take-up or package roll device which includes a cradle mechanism 44 carrying a pair of centering discs 45, 46 between which is carried a take-up bobbin B upon which the yarn Y is wound after being processed by the spindle assembly 6 for forming a take-up package of processed yarn. The take-up bobbin B is rotated by driven friction drive roll 47 contacting the outside surface of the yarn Y being wound on the bobbin B in a well known manner. Further details of operation and construction of these elements of the take-up assembly 7 are well known to those with ordinary skill in the art and are not needed for an understanding of the present invention.

With the above-described mechanisms of the spindle assembly 6 and the take-up assembly 7, the yarn Y is withdrawn from the package P, passes through the pigtail flyer mechanism 37, through the yarn entry tube 30 and the yarn passageway 31. From the passageway 31, the yarn Y passes through the generally L-shaped yarn passageway 20 of the rotating rotor mechanism 11 and out of the reserve disc 16. The yarn Y then passes upwardly through the space between the basket device 26 and the balloon limitor 33 to form a rotating balloon of yarn Y as the rotor mechanism 11 is rotated. The yarn Y then passes through yarn guide eyelet 40 which limits the upper end of the rotating balloon of yarn, over pre-take-up roll 42 and is traversed by traversing mechanism 43 onto the bobbin B carried by the centering disc 45, 46 of the cradle mechanism 44 of the package roll device to complete its travel through the respective spindle assembly 6 and take-up assembly 7 of the yarn processing station 5. As is well understood by those with ordinary skill in the art, a two-for-one twist is inserted in the yarn during the above-noted path of travel.

The yarn processing station 5 may further include pneumatically-operated yarn threading mechanisms for automatically threading yarn Y withdrawn from the supply package P through the yarn passageway 31, 20 and through the space between the basket device 26 and the balloon limitor 33 during threading-up of the spindle assembly 6. These automatic, pneumatic, threading mechanisms may be constructed generally in accordance with the above-mentioned U.S. Pat. Nos. 3,975,873 or 3,731,478 of the assignee of the present invention; however, the pneumatic threading-up mechanisms of assignee's U.S. Pat. No. 3,975,873 have been broadly illustrated and will be described herein.

As may be seen in the drawings, particularly FIG. 8, these pneumatic threading-up mechanisms include a selectively-operated, air injector nozzle, generally indicated at 50, which selectively receive air under pressure from a connector 65 leading from a suitable source of compressed air and which is movably mounted for movement into and out of engagement with an aperture 67 in the bottom portion 27 of the carrier mechanism 25 through an aperture 66 in the balloon limitor 33. The aperture 67 leads by way of an air passageway 68 through the carrier mechanism 25 to the injector nozzle 50 for creating a positive air stream through the yarn passageway 20 through the rotor mechanism 11 and through the space between the basket device 26 and the balloon limitor 33 and a negative air flow of suction through the yarn passageway 31 of the carrier mechanism 25. The connector member 65 may be selectively moved into and out of engagement with the aperture 67 by means of a suitable piston and cylinder device 69.

By the above arrangement, when the connector 65 is selectively inserted into the aperture 67 in the stationary carrier mechanism 25 by movement through the aperture 66 in the balloon limitor 33 by the piston and cylinder mechanism 69, the above-described air streams will be created so that yarn Y pulled from the supply package P and placed at the entry to yarn passageway 31 through the yarn entry tube 30 will be sucked into the yarn passageway 31 to be pneumatically threaded therethrough and out of the yarn passageway 20 and up through the space between the basket device 26 and the balloon limitor 33 for automatic threading-up of the spindle assembly 6 during start-up or in the event of yarn breakage during yarn processing.

In accordance with the present invention, yarn guiding and threading mechanisms, broadly indicated at 75, are operatively associated with each yarn processing station 5 and each spindle assembly 6 and take-up assembly 7 for being positioned generally at the front thereof to complete threading-up of the spindle assembly 6 and the take-up assembly 7 by receiving the yarn Y emerging from the space between the basket device 26 and the balloon limitor 33 during pneumatic threading-up of the spindle assembly 6 and guiding the yarn upwardly therethrough and conveying the yarn Y to the take-up assembly 7 and onto the bobbin B to complete automatic threading-up of the yarn processing station 5 to eliminate manual handling of the yarn Y.

The yarn guiding and threading mechanisms 75 comprise a generally vertically-extending elongate tube 76 having an air passageway 77 therethrough and a generally funnel-shaped lower end 78. A suction air conduit 80 is connected to the upper end of the tube 76 and leads therefrom to a suitable source of suction (not shown) indicated by the arrow in FIG. 1, for creating a suction through the tube 76 for receiving the free end of yarn Y passing upwardly from between the basket device 26 and the balloon limitor 33 during pneumatic threading of the spindle assembly 6 at the funnel-shaped lower end 78 and for guiding the free end of yarn Y upwardly through the passageway 77 in the tube 76 and into the suction conduit 80. A slot 81 extends from the outside of the tube 76 to the passageway 77 along substantially the entire length of the tube 76 and at least from the funnel-shaped lower end 78 up a substantial portion of the length of the tube 76. The slot 81 is positioned on the side of the tube 76 facing the spindle assembly 6 and the take-up assembly 7 for removal of the yarn through the slot 81 from the tube 76, for purposes to be described below.

Figure 3:
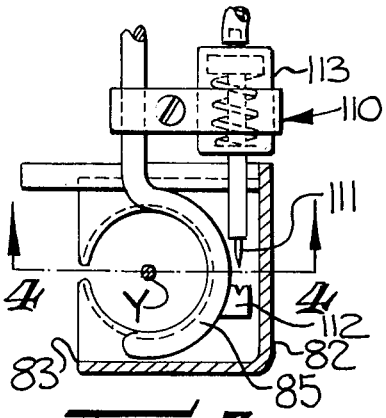
FIG. 3 is an enlarged cross-sectional detail, taken generally along the line 3—3 of FIG. 2.
Figure 4:
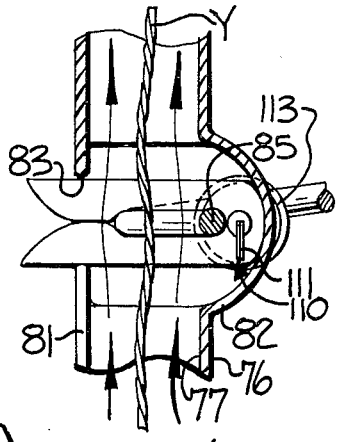
FIG. 4 is a cross-sectional detail, taken generally along the line 4—4 of FIG. 3.

An enlarged pocket portion 82 is provided in the upper end of the tube 76 and includes an open front 83 facing the spindle and take-up assemblies 6, 7 and communicating with the slot 81 in the tube 76. A yarn carrier member 84 is provided which has a hook portion 85 on one end thereof open toward the spindle and take-up assembly 6, 7 and has means on the other end thereof for mounting the carrier member 84 for movement between a first position (shown in solid lines in FIG. 2) in which the hook portion 85 of the carrier member 84 is positioned within the pocket portion 82 of the tube 76 and forms a part of the passageway 77 therethrough (see FIGS. 3 and 4) to a second position (dotted line position of FIG. 2) closely adjacent the take-up bobbin B in the cradle device 44 of the take-up assembly 7 for conveying the yarn Y from the tube 76 through the slot 81 therein and positioning the yarn Y on the take-up bobbin B to complete threading-up of the spindle and take-up assemblies 6, 7. To provide movement of the carrier member 84 from its first position to its second position and return, the lower end of the carrier member 84 comprises a crank arm 87 pivotally mounted at 88 to a stationary frame member and connected at 89 to a piston 90 of a piston and cylinder mechanism 90, 91 for being selectively actuated to move the carrier member 84 between the above-described positions.

Figure 9:
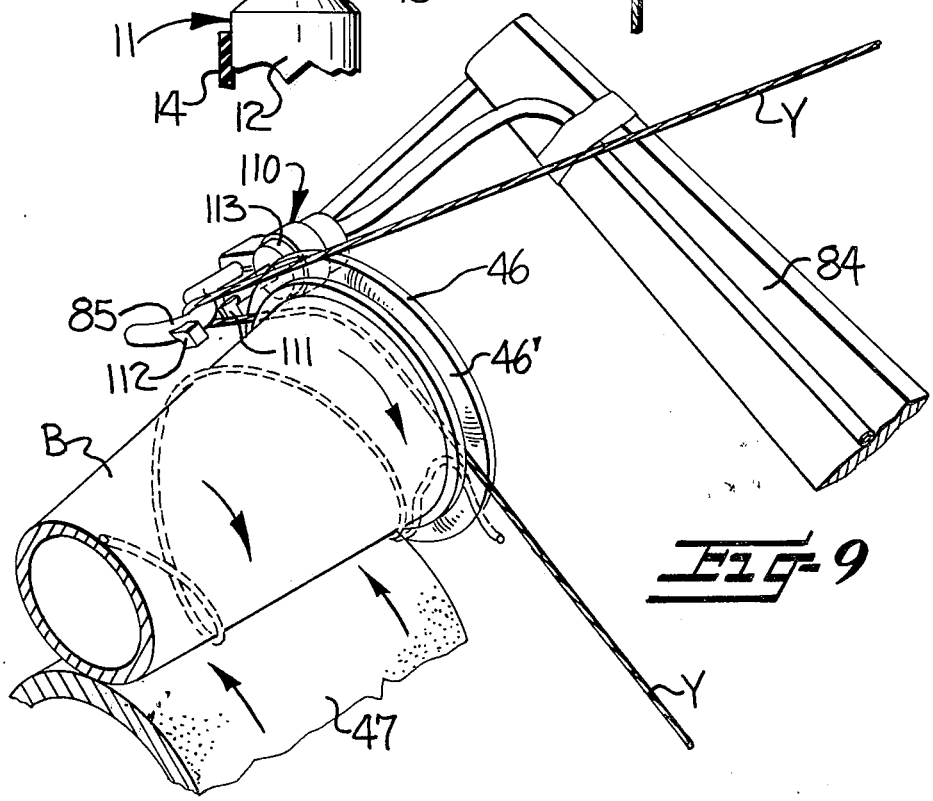
FIG. 9 is an enlarged perspective detail illustrating insertion of the yarn by the carrier member into the gap between one of the centering discs of the cradle device of the take-up assembly and the take-up bobbin carried thereby for completing threading-up of the yarn between the spindle assembly and the take-up mechanism.

In order for the yarn Y to be received and held in the take-up assembly 7 when conveyed thereto by the carrier member 84, at least one of the centering discs 46 includes an oblique face 46' thereon which forms a gap (see FIG. 9) between the oblique face 46' and the end of the take-up bobbin B so that the yarn Y may be inserted by the hook portion 85 of the carrier member 84 into the gap for being pinched therebetween and held for receipt on the surface of the take-up bobbin B during rotation thereof for starting up a take-up package of processed yarn.

Figure 5:
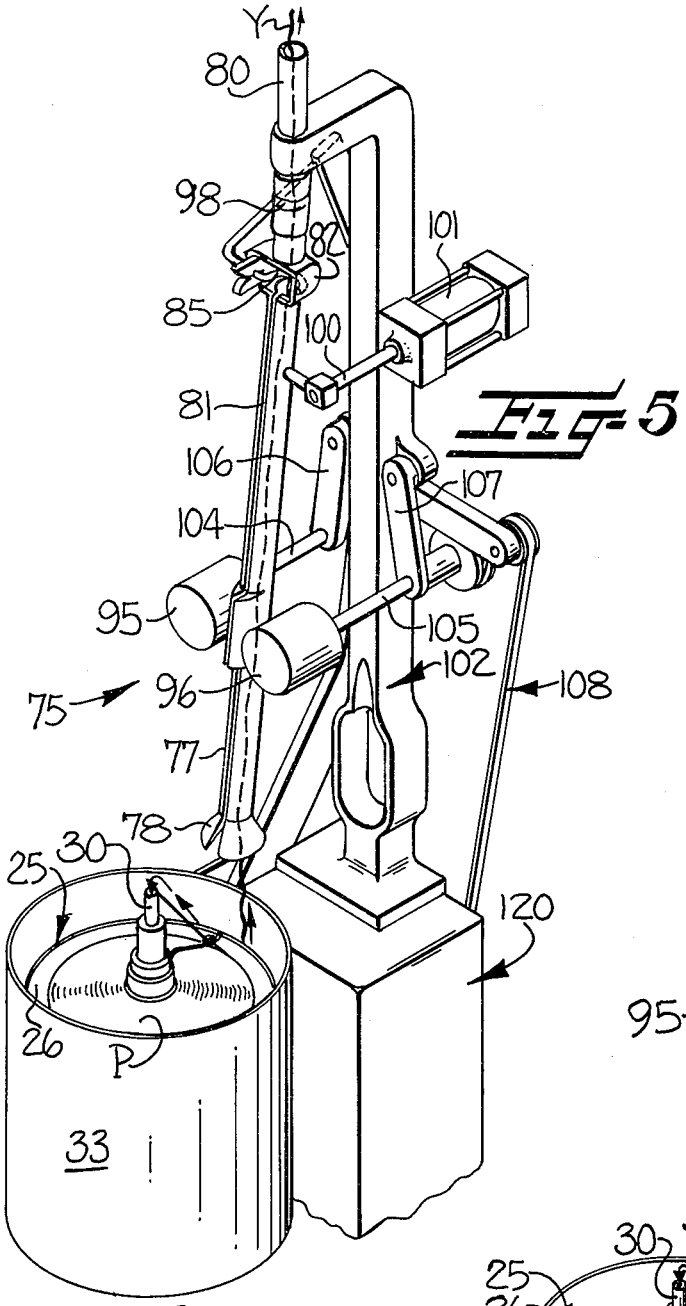
FIG. 5 is a somewhat schematic, perspective view of a portion of the apparatus illustrated in FIG. 1 showing the tube and the delivery rolls of the yarn guiding and threading mechanisms in their first positions for receipt of the free end of yarn from the spindle assembly by the tube and for guiding the yarn through the tube.
Figure 6:
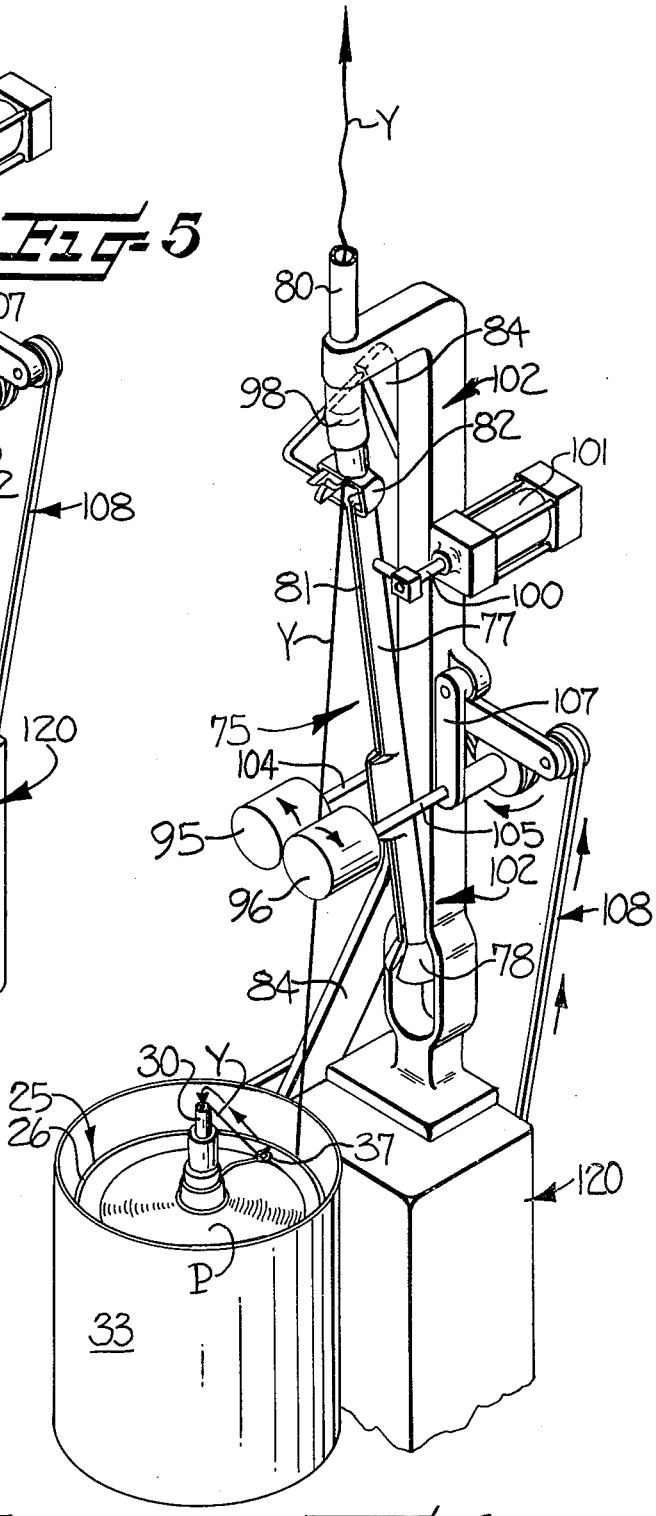
FIG. 6 is a view, like FIG. 5, illustrating the tube of the yarn guiding and threading mechanisms in its second position along with the driven delivery rolls in yarn feeding engagement with the yarn extending from the spindle assembly.
Figure 7:
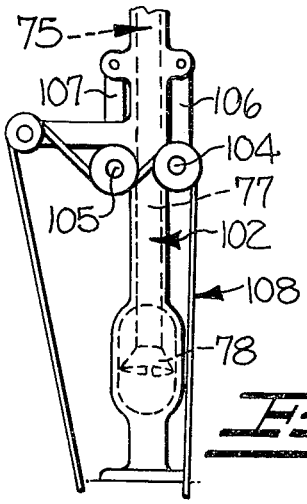
FIG. 7 is an elevational detail of a portion of the drive means for the delivery rolls.

The yarn guiding and threading mechanism 75 may preferably further include driven delivery rolls 95, 96 operatively positioned with respect to the tube 76 for receipt of the yarn Y after the free end has passed into the suction conduit for further feeding of the yarn Y from the supply package as the free end thereof is held in the suction conduit 80 during movement of the yarn carrier 84 to its second position. For cooperation with the driven delivery rolls 95, 96, the tube 76 includes a pivotal mounting 98 at the upper end thereof above the pocket portion 82 for movement from a first position (FIG. 5) for receipt of the free end of yarn Y emerging upwardly from the spindle assembly 6 to a second position (FIG. 6) out of the path of travel of the yarn Y from the spindle assembly 6 into the suction conduit 80 so that the yarn may be removed from the slot 81 in the tube 76 for receipt between the driven delivery rolls 95, 96 (FIG. 6). For this movement of the tube 76 between its first and second positions, a piston and cylinder mechanism 100, 101 may be connected to the tube 76 by the piston 100 being connected to the tube 76 and the cylinder 101 being connected to an upstanding frame portion 102 so that the piston and cylinder mechanism 100, 101 may be actuated to move the tube 76 between its first and second positions.

The delivery rolls 95, 96 are mounted on respective driven shafts 104, 105 which are carried by respective lever arms 106, 107 which are pivotally mounted on the upstanding frame portion 102 for movement of the delivery rolls 95, 96 between a first position (FIG. 5) out of yarn feeding engagement with each other when the tube 76 is in its first position to a second position (FIG. 6) in engagement with each other for receiving the yarn therebetween and for feeding of the yarn when the tube is moved to its second position. The delivery rolls 95, 96 are driven by a belt drive mechanism broadly indicated at 108 from a motor 109 or from a drive in the textile machine, preferably at a speed approximating the speed of rotation of the take-up bobbin B so that the yarn Y will be fed by the delivery rolls 95, 96 onto the bobbin B at a speed substantially the same as the speed of rotation of the bobbin B for ease in start-up of the spindle and take-up assembly 6, 7. The delivery rolls 95, 96 may be moved between their positions by any suitable means such as a separating blade on the front of the tube 76 for separating the rolls 95 and by the tension of the belt drive device or gravity into engagement with each other or other suitable means.

The yarn guiding and threading mechanism 75 also preferably include a cutter mechanism 110 carried by the hook portion 85 of the yarn carrier member 84 for being selectively actuated when the yarn carrier member 84 moves to its second position and the yarn is held in the gap between the bobbin B and the centering disc 46 for cutting the yarn Y so that the free end of yarn extending into the suction conduit 80 may be removed by being fed into a waste collector at the suction source and the cut end of yarn will be held at the bobbin B for start-up of the winding of a package of processed yarn on the bobbin B. The cutter mechanism 110 may be any suitable cutter and as illustrated, particularly in FIG. 3, may include a pneumatically actuated movable blade 111 and a stationary blade 112 controlled by a piston and cylinder device 113 which receives compressed air from a conduit 114 leading along the carrier member 84 to a suitable source of compressed air (not shown).

The above-described yarn guiding and threading mechanisms 75 are preferably carried by a trolley mechanism 120 which is suitably mounted on rails 121, 122 by wheels or rollers 123 for movement along each side of the yarn processing machine and along each of the yarn processing stations 5 so that the yarn guiding and threading mechanisms 75 may be selectively positioned in front of respective spindle and take-up assemblies 6, 7 when a threading-up operation is desired. As illustrated in the drawings herein, the connector 65 of the spindle assembly threading mechanisms may also be carried by the trolley mechanism 120 for desired positioning at a specific spindle assembly location when the threading-up operation is desired. The trolley mechanism 120 may be driven by drive motor 126 for automatic positioning.

The yarn guiding and threading mechanisms 75 of this invention may include a suitable control circuit or other type of control mechanisms (not shown) for effecting automatic operation of the above-described yarn guiding and threading mechanisms 75 of this invention along with positioning of the trolley mechanism 120 and operation of the connector member 65; however, such a control does not form a specific part of this invention and will not be described herein.

As may be seen from the above description, a cycle of operation of the mechanisms of this invention is generally as follows.

When a take-up package of yarn Y has been doffed from the cradle mechanism 44 of the take-up assembly 7 of the textile yarn processing machine following yarn processing thereof or when a yarn Y being processed has broken and a threading-up operation of the spindle assembly 6 and the take-up assembly 7 is desired, the trolley mechanism 120 is automatically or manually positioned in front of the spindle and take-up assemblies 6, 7 of the respective yarn processing station 5 and the connector member 65 of the spindle assembly pneumatic threading mechanisms is actuated and inserted into the aperture 67 for creating air streams through the spindle assembly for automatic, pneumatic threading thereof. The free end of yarn Y is then pulled from the supply package P and is placed in position at the yarn entry tube 30 for being sucked into and through the passageway 31, 20 through the spindle assembly for pneumatic threading therethrough and up through the space between the basket device 26 and the balloon limitor 33.

A suction is created through the suction conduit 80 and thus through the tube 76 so that the free end of yarn Y emerging from the spindle assembly 6 will be drawn into the passageway 77 through the tube 76 and into the suction conduit 80. The tube 76 will then be pivoted to its second position and the delivery feed rolls 95, 96 will be brought into engagement with the yarn Y and begin feeding the yarn Y in an upward direction into the suction conduit 80 at a speed approximating that of the rotation of the take-up bobbin B. The carrier 84 will then be moved to its second position so that the hook portion 85 thereof will engage the yarn Y and carry the yarn Y to the take-up bobbin B in the take-up assembly 7 for receipt in the gap between the centering disc 46 and the bobbin B to be held therein. The yarn cutter 110 will be actuated to cut the yarn allowing the free end of yarn Y in the suction conduit 80 to be removed and the cut end of yarn Y to be retained on the bobbin B completing threading-up of the yarn processing station 5 and eliminating manual handling of the yarn Y. Following threading-up, as described above, the yarn Y being held in the gap between the bobbin B and the centering disc 46 will be engaged by the traversing mechanism which will move the yarn Y laterally for receipt by the pre-take-up roll 42 and the self-threading pigtail yarn guide 40 for continued operation of the yarn processing station 5.

In the drawings and specification there has been set forth a preferred embodiment of this invention, and although specific terms are employed, they are used in a generic and descriptive sense only and not for purposes of limitation.

What is claimed is:

1. In a textile yarn processing machine, such as a two-for-one twister or the like, the combination of:

a plurality of spindle assemblies mounted in generally side-by-side relationship along the outside of said machine and each including a driven rotating rotor mechanism, a stationary carrier mechanism for carrying a hollow supply package of yarn and having a basket device surrounding the supply package, a balloon limitor device surrounding said basket device and providing a space therebetween, and an elongate yarn passageway extending downwardly through the top of said carrier mechanism along the axis of said spindle assembly and radially outwardly through said rotor mechanism into said space between said basket device and said balloon limitor for the passage of yarn from the supply package downwardly and outwardly through said passageway and upwardly through said space during yarn processing;

a processed yarn take-up assembly positioned above each of said spindle assemblies for forming a take-up package of processed yarn and including a cradle device having centering discs for carrying a driven take-up bobbin therebetween for the winding of processed yarn thereon;

selectively-operable pneumatic threading mechanisms for being operated to automatically thread a free end of yarn withdrawn from the supply package through said yarn passageway and through said space between said basket device and said balloon limitor during threading-up of said spindle assemblies by creating a suction through the yarn entry portion of said passageway and a positive air stream through the yarn exit portion of said passageway and through said space between said basket device and said balloon limitor; and yarn guiding and threading means operatively associated with each of said spindle and take-up assemblies for being positioned generally at the front thereof and comprising a generally vertically-extending elongate tube having an air passageway therethrough and a source of suction connected to the upper end thereof for creating a suction therethrough for receiving at the lower end thereof the free end of yarn passing upwardly from between said basket device and said balloon limitor during pneumatic threading of said spindle assembly and for guiding the free end of yarn upwardly through said tube, a slot extending from the outside of said tube to said passageway along substantially the length thereof and positioned on the side thereof facing said spindle assembly for removal of the yarn from said tube, and a yarn carrier including means movably mounting said carrier for movement between a first position for engaging the yarn passing through said tube to a second position closely adjacent the take-up bobbin in said cradle device of said take-up assembly for conveying the yarn from said tube through said slot therein and positioning the yarn on the take-up bobbin to complete threading-up of said spindle assembly and said take-up assembly to eliminate manual handling of the yarn during threading-up operations.

2. In a textile yarn processing machine, as set forth in claim 1, further including a trolley mechanism mounted for movement along the outside of said textile yarn processing machine and along the front of each of said spindle assemblies and carrying said yarn guiding and threading means so that said yarn guiding and threading means may be conveniently positioned in front of a respective spindle assembly when a threading-up operation of said spindle assembly and said take-up assembly is desired.

3. In a textile yarn processing machine, as set forth in claim 1, in which said yarn carrier of said yarn guiding and threading means includes a hook portion on one end thereof being open toward said spindle and take-up assemblies and having said mounting means at the other end thereof, and said tube of said yarn guiding and threading means includes a pocket portion in the upper part thereof through which said air passageway passes and having an open front facing said spindle and take-up assemblies for receipt of said hook portion of said carrier member therein in the first position of said carrier member so that the opening through said hook member forms a part of said air passageway and so that said hook member may be moved to the second position of said yarn carrier while carrying and conveying the yarn therewith out of said tube.

4. In a textile yarn processing machine, as set forth in claim 1, in which the lower end of said tube of said yarn guiding and threading means comprises a funnel-shaped configuration to aid in receiving by suction the free end of yarn into the air passageway therethrough.

5. In a textile yarn processing machine, as set forth in claim 1, in which said source of suction connected to the upper end of said tube of said yarn guiding and threading means includes a conduit connected at one end to the upper end of said tube and leading therefrom to said source of suction for receiving the free end of yarn therethrough after passage through said tube and for holding the free end of yarn as said yarn carrier conveys the yarn to the take-up bobbin in said take-up assembly.

6. In a textile yarn processing machine, as set forth in claim 5, in which said yarn guiding and threading means further includes driven delivery roll means operatively positioned with respect to said tube for receipt of the yarn after the free end has passed into said suction conduit for further feeding yarn from the supply package carried by said spindle assembly into said suction conduit during movement of said yarn carrier to its second position and means operatively connected with said delivery roll means for driving said delivery roll means at a speed approximately the same as the take-up bobbin carried by said take-up assembly so that the yarn may be conveyed to the take-up bobbin while moving at a speed approximating the take-up speed of the yarn.

7. In a textile yarn processing machine, as set forth in claim 6, in which said yarn guiding and threading means further includes means pivotally mounting the upper end of said tube for movement from a first position for receipt of the free end of yarn emerging upwardly from said spindle assembly to a position out of the path of travel of the yarn from said spindle assembly into said suction conduit so that the yarn will be removed through said slot from said tube, and means mounting said delivery roll means for pivotal movement from a position out of yarn feeding engagement with each other when said tube is in its first position to a position in engagement with each other for receiving the yarn therebetween and for feeding of the yarn when said tube is moved to its second position so that the yarn from said spindle assembly will be fed onto the take-up bobbin at approximately the same speed as that of the take-up bobbin.

8. In a textile yarn processing machine, as set forth in claim 7, in which said yarn guiding and threading means further includes cutter means carried by said yarn carrier for being selectively actuated when said yarn carrier moves to the second position thereof and the yarn is applied to the take-up bobbin carried by said take-up assembly for cutting the yarn so that the free end thereof may be conveyed through said suction conduit for removal and the cut end may be wound on the take-up bobbin of said take-up assembly.

9. In a textile yarn processing machine, as set forth in claim 1, in which at least one of said centering discs of said cradle device of said take-up assembly includes an oblique face forming a gap between said centering disc and the take-up bobbin when held between said centering disc for receiving and holding the yarn conveyed to said take-up assembly by said yarn carrier of said yarn guiding and threading means.

10. In a textile yarn processing machine, such as a two-for-one twister or the like, the combination of:

a plurality of spindle assemblies mounted in generally side-by-side relationship along the outside of said machine and each including a driven rotating rotor mechanism, a stationary carrier mechanism for carrying a hollow supply package of yarn and having a basket device surrounding the supply package, a balloon limitor device surrounding said basket device and providing a space therebetween, and an elongate yarn passageway extending downwardly through the top of said carrier mechanism along the axis of said spindle assembly and radially outwardly through said rotor mechanism into said space between said basket device and said balloon limitor for the passage of yarn from the supply package downwardly and outwardly through said passageway and upwardly through said space during yarn processing;

a processed yarn take-up assembly positioned above each of said spindle assemblies for forming a take-up package of processed yarn and including a cradle device having centering discs for carrying a driven take-up bobbin therebetween for the winding of processed yarn thereon, at least one of said centering discs having an oblique surface forming a gap between said surface and the bobbin for receiving and holding the yarn during start-up;

selectively-operable pneumatic threading mechanisms for being operated to automatically thread a free end of yarn withdrawn from the supply package through said yarn passageway and through said space between said basket device and said balloon limitor during threading-up of said spindle assemblies by creating a suction through the yarn entry portion of said passageway and a positive air stream through the yarn exit portion of said passageway and through said space between said basket device and said balloon limitor;

yarn guiding and threading means operatively associated with each of said spindle and take-up assemblies for being positioned generally at the front thereof and comprising a generally vertically-extending elongate tube having an air passageway therethrough and a generally funnel-shaped lower end, a suction air conduit connected to the upper end of said tube and leading therefrom to a source of suction for creating a suction through said tube for receiving the free end of yarn passing upwardly from between said basket device and said balloon limitor during pneumatic threading of said spindle assembly at said funnel-shaped lower end and for guiding the free end of yarn upwardly through said tube and into said suction conduit, a slot extending from the outside of said tube to said passageway along substantially the length thereof and positioned on the side thereof facing said spindle assembly for the removal of yarn from said tube, an enlarged pocket portion in the upper end of said tube having an open front facing said spindle and take-up assemblies, a yarn carrier having a hook portion on one end thereof opened toward said spindle and take-up assemblies and having means on the other end thereof mounting said carrier for movement between a first position in which said hook portion is positioned within said pocket portion of said tube and forms a part of said passageway therethrough to a second position closely adjacent the take-up bobbin in said cradle device of said take-up assembly for conveying the yarn from said tube through said slot therein and positioning the yarn within said gap between the take-up bobbin and said centering disc to complete threading-up of said spindle and take-up assemblies to eliminate manual handling of the yarn during threading-up operations, driven delivery roll means operatively positioned with respect to said tube for receipt of the yarn after the free end has passed into said suction conduit for feeding yarn from the supply package during movement of said yarn carrier to its second position and including means driving said delivery roll means at a speed approximately the same as the take-up bobbin carried by said take-up assembly so that the yarn may be conveyed onto the take-up bobbin while moving at a speed approximating the take-up speed of the yarn, means pivotally mounting the upper end of said tube for movement from a first position for receipt of the free end of yarn emerging upwardly from said spindle assembly to a position out of the path of travel of the yarn from said spindle assembly into said suction conduit so that the yarn may be removed through said slot from said tube, means mounting said delivery roll means for pivotal movement from a position out of yarn feeding engagement with each other when said tube is in its first position to a position in engagement with each other for receiving the yarn therebetween and for feeding of the yarn when said tube is moved to its second position, and cutter means carried by said yarn carrier for being selectively actuated when said yarn carrier moves to its second position and the yarn is held in said gap between the bobbin and said centering disc for cutting the yarn so that the free end of yarn extending into said suction conduit may be removed; and a trolley mechanism mounted for movement along the outside of said textile yarn processing machine and along the front of each of said spindle and take-up assemblies and carrying said yarn guiding and threading means so that said yarn guiding and threading means may be conveniently positioned in front of a respective spindle assembly when a threading-up operation thereof is desired.

11. In a textile yarn processing machine having a plurality of spindle assemblies mounted in generally side-by-side relationship along the outside of the machine and each carrying a supply package of yarn for processing of the yarn during passage through said spindle assembly, and a processed yarn take-up assembly positioned generally axially above each of said spindle assemblies for receiving the processed yarn therefrom and for forming a take-up package of processed yarn; the combination therewith of yarn guiding and threading means operatively associated with each of said spindle and take-up assemblies for being positioned generally at the front thereof for receiving and guiding the yarn emerging from said spindle assembly during threading-up thereof and for conveying the yarn to said take-up assembly for automatic threading-up thereof to eliminate manual handling of the yarn, said yarn guiding and threading means comprising:

a generally vertically-extending elongate tube having an air passageway therethrough;

a source of suction connected to the upper end of said tube for creating a suction through said tube for receiving at the lower end of said tube the yarn from said spindle assembly and for guiding the yarn upwardly through said tube;

a slot extending from the outside of said tube to said passageway therein along the length thereof and positioned on the side thereof facing said spindle assembly for removal of the yarn from said tube; and a yarn carrier including means movably mounting said carrier for movement between a first position for engaging the yarn passing through said tube to a second position closely adjacent said processed yarn take-up assembly for conveying the yarn from said tube through said slot therein and positioning the yarn in said take-up assembly to complete threading-up of said spindle assembly and said take-up assembly.

12. In a textile yarn processing machine, as set forth in claim 11, further including a trolley mechanism mounted for movement along the outside of said textile yarn processing machine and along the front of each of said spindle assemblies and carrying said yarn guiding and threading means so that said yarn guiding and threading means may be conveniently positioned in front of a respective spindle assembly and take-up assembly when a threading-up operation of said spindle assembly and said take-up assembly is desired.

13. In a textile yarn processing machine, as set forth in claim 11, in which said yarn carrier of said yarn guiding and threading means includes a hook portion on one end thereof being opened toward said spindle and take-up assemblies and having said mounting means at the other end thereof, and said tube of said yarn guiding and threading means includes an enlarged pocket portion in the upper part thereof through which said air passageway passes and having an open front facing said spindle and take-up assemblies for receipt of said hook portion of said carrier member therein in the first position of said carrier member so that the opening through said hook member forms a part of said air passageway and so that said hook member may be moved to the second position of said yarn carrier while carrying and conveying the yarn therewith out of said tube.

14. In a textile yarn processing machine, as set forth in claim 11, in which the lower end of said tube of said yarn guiding and threading means comprises a funnel-shaped configuration to aid in receiving by suction the free end of yarn into the air passageway therethrough.

15. In a textile yarn processing machine, as set forth in claim 11, in which said source of suction connected to the upper end of said tube of said yarn guiding and threading means includes a conduit connected at one end to the upper end of said tube and leading therefrom to said source of suction for receiving the free end of yarn therethrough after passage through said tube and for holding the free end of yarn as said yarn carrier conveys the yarn to said take-up assembly.

16. In a textile yarn processing machine, as set forth in claim 15, in which said yarn guiding and threading means further includes driven delivery roll means operatively positioned with respect to said tube for receipt of the yarn after the free end has passed into said suction conduit for further feeding yarn from the supply package carried by said spindle assembly into said suction conduit during movement of said yarn carrier to its second position, and drive means connected with said delivery roll means for driving said delivery roll means at a desired speed so that the yarn may be conveyed to the take-up bobbin while moving at a speed approximating the take-up speed of the yarn in said take-up assembly.

17. In a textile yarn processing machine, as set forth in claim 16, in which said yarn guiding and threading means further includes means pivotally mounting the upper end of said tube for movement from a first position for receipt of the free end of yarn emerging upwardly from said spindle assembly to a position out of the path of travel of the yarn from said spindle assembly into said suction conduit so that the yarn will be removed through said slot from said tube, and means mounting said delivery roll means for pivotal movement from a position out of yarn feeding engagement with each other when said tube is in its first position to a position in engagement with each other for receiving the yarn therebetween and for feeding of the yarn when said tube is moved to its second position.

18. In a textile yarn processing machine, as set forth in claim 17, in which said yarn guiding and threading means further includes cutter means carried by said yarn carrier for being selectively actuated when said yarn carrier moves to the second position thereof cutting the yarn so that the free end thereof may be conveyed through said suction conduit for removal and the cut end may be wound in said take-up assembly.

19. In a textile yarn processing machine, such as a two-for-one twister or the like, having a plurality of spindle assemblies mounted in generally side-by-side relationship along the outside of the machine and each carrying a supply package of yarn for processing of the yarn during passage through said spindle assembly, a processed yarn take-up assembly positioned generally axially above each of said spindle assemblies for receiving the processed yarn therefrom and for forming a take-up package of processed yarn, selectively-operable threading mechanisms operatively associated with each of said spindle assemblies for automatically threading yarn from the supply package through said spindle assembly and emerging from said spindle assembly generally at the top thereof; the combination therewith of yarn guiding and threading means operatively associated with each of said spindle and take-up assemblies for being positioned generally at the front thereof for receiving and guiding the yarn emerging from said spindle assembly during threading-up thereof and for conveying the yarn to said take-up assembly for automatic threading-up thereof to eliminate manual handling of the yarn during threading-up operations, said yarn guiding and threading means comprising:

a generally-vertically elongate tube having an air passageway therethrough and a generally funnel-shaped lower end;

a suction conduit connected to the upper end of said tube and leading therefrom to a source of suction for creating a suction through said tube for receiving the free end of yarn emerging from said spindle assembly at said funnel-shaped lower end and for guiding the free end of yarn upwardly through said tube and into said suction conduit;

a slot extending from the outside of said tube to said passageway along substantially the length thereof and positioned on the side thereof facing said spindle assembly for the removal of the yarn from said tube;

an enlarged pocket portion in the upper end of said tube having an open front facing said spindle and take-up assemblies and forming a part of said yarn passageway through said tube;

a yarn carrier having a hook portion on one end thereof opened toward said spindle and take-up assemblies and having means on the other end thereof mounting said carrier for movement between a first position in which said hook portion is positioned within said pocket portion of said tube and forms a part of said passageway therethrough to a second position closely adjacent said take-up assembly for conveying the yarn from said tube through said slot therein and positioning the yarn in said take-up assembly to complete threading-up of said spindle and take-up assemblies; and a trolley mechanism mounted for movement along the outside of said textile yarn processing machine and along the front of each of said spindle and take-up assemblies and carrying said yarn guiding and threading means so that said yarn guiding and threading means may be conveniently positioned in front of a respective spindle assembly and take-up assembly when a threading-up operation thereof is desired.

20. In a textile yarn processing machine, such as a two-for-one twister or the like, having a plurality of spindle assemblies mounted in generally side-by-side relationship along the outside of the machine and each carrying a supply package of yarn for processing of the yarn during passage through said spindle assembly, a processed yarn take-up assembly positioned generally axially above each of said spindle assemblies for receiving the processed yarn therefrom and for forming a take-up package of processed yarn, selectively-operable threading mechanisms operatively associated with each of said spindle assemblies for automatically threading yarn from the supply package through said spindle assembly and emerging from said spindle assembly generally at the top thereof; the combination therewith of yarn guiding and threading means operatively associated with each of said spindle and take-up assemblies for being positioned generally at the front thereof for receiving and guiding the yarn emerging from said spindle assembly during automatic threading-up thereof and for conveying the yarn to said take-up assembly for automatic threading-up thereof to eliminate manual handling of the yarn during threading-up operations, said yarn guiding and threading means comprising:

a generally vertically-extending elongate tube having an air passageway therethrough and a generally funnel-shaped lower end;

a suction air conduit connected to the upper end of said tube and leading therefrom to a source of suction for creating a suction through said tube for receiving the free end of yarn passing upwardly from said spindle assembly at said funnel-shaped lower end and for guiding the free end of yarn upwardly through said tube and into said suction conduit;

a slot extending from the outside of said tube to said passageway along substantially the length thereof and positioned on the side thereof facing said spindle assembly for the removal of yarn from said tube;

an enlarged pocket portion in the upper end of said tube having an open front facing said spindle and take-up assemblies and forming a part of said yarn passageway therethrough;

a yarn carrier having a hook portion on one end thereof opened toward said spindle and take-up assemblies and having means on the other end thereof mounting said carrier for movement between a first position in which said hook portion is positioned within said pocket portion of said tube and forms a part of said passageway therethrough to a second position closely adjacent said take-up assembly for conveying the yarn from said tube through said slot therein and positioning the yarn in said take-up assembly to complete threading-up of said spindle and take-up assemblies;

driven delivery roll means operatively positioned with respect to said tube for receipt of the yarn after the free end has passed into said suction conduit for further feeding yarn from the supply package during movement of said yarn carrier to its second position and including means driving said delivery roll means at a speed approximately the same as the take-up speed of the yarn in said take-up assembly so that the yarn may be conveyed to said take-up assembly while moving at a speed approximating the take-up speed of the yarn;

means pivotally mounting the upper end of said tube for movement from a first position for receipt of the free end of yarn emerging upwardly from said spindle assembly to a position out of the path of travel of the yarn from said spindle assembly into said suction conduit so that the yarn may be removed through said slot from said tube;

means mounting said delivery roll means for pivotal movement from a first position out of yarn feeding engagement with each other when said tube is in its first position to a position in engagement with each other for receiving the yarn and for feeding of the yarn when said tube is moved to its second position;

cutter means carried by said yarn carrier for being selectively actuated when said yarn carrier moves to its second position and the yarn is being fed into said take-up assembly for cutting the yarn so that the free end of the yarn extending into said suction conduit may be removed; and a trolley mechanism mounted for movement along the outside of said textile yarn processing machine and along the front of each of said spindle and take-up assemblies and carrying said yarn guiding and threading means so that said yarn guiding and threading means may be conveniently positioned in front of a respective spindle assembly and take-up assembly when a threading-up operation thereof is desired.

21. Yarn guiding and threading means for use with textile machines processing yarn, such as during a threading-up operation of the textile machine, characterized by a construction adapted for receiving a free end of yarn from a first location in the machine, for guiding the yarn from said first location and for conveying the yarn to a desired second location in the machine, said yarn guiding and threading means comprising:

an elongate tube having an air passageway therethrough;

a source of suction connected to one end of said tube for creating a suction through said tube for receiving at the other end of said tube the free end of yarn from the first location in the textile machine and for guiding the yarn through said tube;

a slot extending from the outside of said tube to said passageway therein along the length thereof and positioned on the side thereof adapted to face the textile machine for subsequent removal of the yarn from said tube;

an enlarged pocket portion positioned generally at the one end of said tube and having an open front adapted to face the textile machine and forming a part of said yarn passageway through said tube; and a yarn carrier having a hook portion on one end thereof opened toward the textile machine and having means on the other end thereof mounting said carrier for movement between a first position in which said hook portion is positioned within said pocket portion of said tube and forms a part of said passageway therethrough to a second position at the second location in the textile machine for conveying the yarn from said tube through said slot therein and positioning the yarn at the second location in the textile machine.

22. Yarn guiding and threading means, as set forth in claim 21, further including a movable trolley mechanism adapted to be positioned along the outside of the textile machine and carrying said yarn guiding and threading means for conveniently positioning said yarn guiding and threading means at a desired location along the textile machine.

23. Yarn guiding and threading means, as set forth in claim 21, in which the other end of said tube comprises a funnel-shaped configuration to aid in receiving by suction the free end of yarn into the passageway therethrough.

24. Yarn guiding and threading means, as set forth in claim 21, in which said source of suction connected to the one end of said tube includes a conduit connected at one end to the one end of said tube and leading therefrom to said source of suction for receiving the free end of yarn therethrough after passage through said tube and for holding the free end of yarn as said yarn carrier conveys the yarn to the desired second location in the textile machine.

25. Yarn guiding and threading means, as set forth in claim 24, further including driven delivery roll means operatively positioned with respect to said tube for receipt of the yarn after the free end has passed into said suction conduit for further feeding yarn from the first location in the textile machine during movement of said yarn carrier to its second position.

26. Yarn guiding and threading means, as set forth in claim 25, further including means pivotally mounting the one end of said tube for movement from a first position for receipt of the free end of yarn from the first location in the textile machine to a position out of the path of travel of the yarn from such first position into said suction conduit so that the yarn will be removed through said slot from said tube, and means mounting said delivery roll means for pivotal movement from a position out of yarn feeding engagement with each other when said tube is in its first position to a position in engagement with each other for receiving the yarn therebetween and for feeding of the yarn when said tube is moved to its second position.

27. Yarn guiding and threading means, as set forth in claim 26, further including cutter means carried by said yarn carrier for being selectively actuated when said yarn carrier moves to its second position for cutting the yarn so that the free end thereof may be conveyed through said suction conduit for removal and the cut end is free for receipt at the second location in the textile machine.

28. Yarn guiding and threading means for use with textile machines processing yarn, such as during a threading-up operation of a textile machine, characterized by a construction for receiving a free end of yarn from a first location in the machine, for guiding the yarn from such first location and for conveying the yarn to a desired second location in the machine, said yarn guiding and threading means comprising:

an elongate tube having an air passageway therethrough and a generally funnel-shaped end;

a suction conduit connected to the other end of said tube and leading therefrom to a source of suction for creating a suction through said tube for receiving the free end of yarn from the first location in the textile machine at said funnel-shaped end and for guiding the free end of yarn through said tube and into said suction conduit;

a slot extending from the outside of said tube to said passageway along substantially the length thereof and positioned on the side thereof adapted to face the textile machine for removal of the yarn from said tube;

an enlarged pocket portion positioned generally at the other end of said tube having an open front adapted to face the textile machine and forming a part of said yarn passageway through said tube; and a yarn carrier having a hook portion on one end thereof opened toward the textile machine and having means on the other end thereof mounting said carrier for movement between a first position in which said hook portion is positioned within said pocket portion of said tube and forms a part of said passageway therethrough to a second position at the second location in the textile machine for conveying the yarn from said tube through said slot therein and positioning the yarn at the second location in the textile machine.

29. Yarn guiding and threading means for use with textile machines processing yarn such as during a threading-up operation of a textile machine, characterized by a construction for receiving a free end of yarn from a first location in the machine, for guiding the yarn from such first location and for conveying the yarn to a desired second location in the machine, said yarn guiding and threading means comprising:

an elongate tube having an air passageway therethrough and a generally funnel-shaped end;

a suction conduit connected to the other end of said tube and leading therefrom to a source of suction for creating a suction through said tube for receiving the free end of yarn from the first location in the textile machine at said funnel-shaped end and for guiding the free end of yarn through said tube and into said suction conduit;

a slot extending from the outside of said tube to said passageway along substantially the length thereof and positioned on the side thereof adapted to face the textile machine for removal of the yarn from said tube;

an enlarged pocket portion positioned generally at the other end of said tube having an open front adapted to face the textile machine and forming a part of said yarn passageway through said tube;

a yarn carrier having a hook portion on one end thereof opened toward the textile machine and having means on the other end thereof mounting said carrier for movement between a first position in which said hook portion is positioned within said pocket portion of said tube and forms a part of said passageway therethrough to a second position at the second location in the textile machine for conveying the yarn from said tube through said slot therein and positioning the yarn at the second location in the textile machine;

driven delivery roll means operatively positioned with respect to said tube for receipt of the yarn after the free end has passed into said suction conduit for further feeding yarn from the first location in the textile machine during movement of said yarn carrier to its second position;

means pivotally mounting the upper end of said tube for movement from a first position for receipt of the free end of yarn from the first location in the textile machine to a position out of the path of travel of the yarn from such first position into said suction conduit so that the yarn will be removed through said slot from said tube;

means mounting said delivery roll means for pivotal movement from a first position out of yarn feeding engagement with each other when said tube is in its first position to a second position in engagement with each other for receiving the yarn and for feeding the yarn when said tube is moved to its second position;

cutter means carried by said yarn carrier for being selectively actuated when said yarn carrier moves to its second position for cutting the yarn so that the free end thereof may be conveyed through said suction conduit for removal and the cut end is free for receipt at the second location in the textile machine; and a movable trolley mechanism adapted to be positioned along the outside of the textile machine and carrying said yarn guiding and threading means for conveniently positioning said yarn guiding and threading means at a desired location along the textile machine.

* * * * *